US010682858B2

(12) United States Patent
Yoshino et al.

(10) Patent No.: US 10,682,858 B2
(45) Date of Patent: Jun. 16, 2020

(54) LIQUID EJECTING APPARATUS

(71) Applicant: SEIKO EPSON CORPORATION, Tokyo (JP)

(72) Inventors: Keiichiro Yoshino, Matusmoto (JP); Akira Shinoto, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 1974 days.

(21) Appl. No.: 14/086,487

(22) Filed: Nov. 21, 2013

(65) Prior Publication Data

US 2014/0152740 A1 Jun. 5, 2014

(30) Foreign Application Priority Data

Dec. 4, 2012 (JP) ..... 2012-265015

(51) Int. Cl.
*B41J 2/165* (2006.01)

(52) U.S. Cl.
CPC ..... *B41J 2/16535* (2013.01); *B41J 2/165* (2013.01); *B41J 2002/1655* (2013.01); *B41J 2002/1657* (2013.01)

(58) Field of Classification Search
CPC . B41J 2/16535; B41J 2/165; B41J 2002/1657
See application file for complete search history.

(56) References Cited

U.S. PATENT DOCUMENTS 5,239,316 A * 8/1993 Demarchi ..... B41J 2/16535 347/33
2004/0165031 A1* 8/2004 Nishi ..... B41J 2/16535 347/33
2005/0062797 A1* 3/2005 Kachi ..... B41J 2/16535 347/33
2005/0156995 A1 7/2005 Nishino
2005/0219310 A1* 10/2005 Nakamura ..... B41J 2/16535 347/33
2008/0266342 A1* 10/2008 Steinfield ..... B41J 2/16535 347/14
2010/0201741 A1 8/2010 Yamaguchi
2012/0050394 A1 3/2012 Takada et al.

FOREIGN PATENT DOCUMENTS

JP 2001-260368 9/2001
JP 2005-205631 8/2005
JP 2008-229962 10/2008

(Continued)

*Primary Examiner* — Sharon A. Polk
(74) *Attorney, Agent, or Firm* — Workman Nydegger

(57) ABSTRACT

A liquid ejecting apparatus includes a liquid ejecting head which ejects a liquid from a plurality of nozzles disposed on a nozzle surface; an absorbing member which makes contact with the nozzle surface and can absorb a liquid which is adhered to the nozzle surface; and a pressing member which causes the ink absorbing member to contact the nozzle surface by pressing the absorbing member from a side which opposes a side which contacts the nozzle surface. In the liquid ejecting apparatus, a pressure applied to a nozzle peripheral region within the nozzle surface due to the absorbing member which is pressed by the pressing member making contact with the nozzle surface is smaller than a pressure applied to a region other than the nozzle peripheral region within the nozzle surface.

11 Claims, 8 Drawing Sheets

(56) References Cited

FOREIGN PATENT DOCUMENTS

| | | |
|---|---|---|
| JP | 2010-0184447 | 8/2010 |
| JP | 2011-067985 | 4/2011 |
| JP | 2011-079170 | 4/2011 |
| JP | 2012-0071573 | 4/2012 |
| JP | 2013-0144386 | 7/2013 |

* cited by examiner

LIQUID EJECTING APPARATUS

BACKGROUND

1. Technical Field

The present invention relates to a liquid ejecting apparatus which includes an absorbing member which can absorb a liquid which is adhered to a liquid ejecting head.

2. Related Art

In the related art, an ink jet printer, which prints (records) an image by ejecting an ink as an example of a liquid from a liquid ejecting head onto a medium such as paper, is known as a type of liquid ejecting apparatus (for example, refer to JP-A-2008-229962, paragraphs [0023], [0024], [0063], [0064], FIGS. 4 and 5 or the like). Such a printer is normally provided with a maintenance apparatus in order to maintain the characteristics of liquid ejecting from the liquid ejecting head.

For example, it is disclosed in JP-A-2008-229962, that a printer includes, as such a maintenance apparatus, an apparatus which performs maintenance of nozzles and an ink discharge surface (a nozzle surface) of a recording head (a liquid ejecting head). The maintenance apparatus includes at least an ink absorbing member which absorbs an ink, and a pressing member which has elasticity which causes the ink absorbing member to contact the ink discharging surface by pressing from a side which opposes a side which contacts the ink discharging surface. The pressing member includes a freely rotatable roller member which has a groove portion in a surface which contacts the ink absorbing member, and a shaft member which supports the roller member.

The groove portion of the roller member is disposed so as to avoid a position corresponding to ink discharge ports of the recording head. Therefore, when the ink absorbing member is pressed by the roller member and pushed against the ink discharge surface, it is possible to press a portion which corresponds to the ink discharge ports of the ink absorbing member using a flat portion (a portion other than the groove portion) of the roller member. Accordingly, it is possible to improve the adhesion between the ink absorbing member and the ink discharge surface, and to effectively perform the maintenance.

However, in the printer disclosed in JP-A-2008-229962, when the ink absorbing member is pressed by the roller member and pushed against the ink discharge surface, a portion which corresponds to the ink discharge ports of the ink absorbing member, which is pressed by a flat portion (a portion other than the groove portion) of the roller member, is pushed relatively strongly against the nozzle discharge surface. Therefore, there is a problem in that the fibers of the ink absorbing member rub strongly against the peripheral region of the ink discharge ports (the nozzle peripheral region) within the nozzle discharge surface, and that the peripheral region of the nozzle discharge ports is particularly susceptible to abrasion.

Normally, the nozzle discharge surface is subjected to surface treatment such as liquid repellant processing. However, when the nozzle discharge surface is abraded, in particular, when the liquid repellence of the nozzle peripheral region near the nozzles (the ink discharge ports) is reduced, an ink such as ink mist which is adhered to the nozzle discharge surface is more likely to spread wetly. When ink droplets which are ejected from the nozzles make contact with the wetly spread ink, this causes the ink droplets to fly astray, which causes the landing position (the dot position) of the ink droplets onto the recording medium to be shifted and brings about a reduction in the printed image quality. In particular, when the liquid is a pigment ink, the nozzle discharge surface is even more susceptible to abrasion due to the abrasive effect of the pigment particles within the ink which is absorbed by the ink absorbing member. Naturally, even if the liquid is a dye ink or a wet liquid, when the nozzle discharge surface is repeatedly rubbed comparatively strongly by the ink absorbing member, the liquid repellence of the nozzle peripheral region is reduced. Therefore, the same problem is present regardless of the type of the liquid.

SUMMARY

An advantage of some aspects of the invention is to provide a liquid ejecting apparatus which can effectively remove a liquid which is adhered to the nozzle surface while suppressing the damage to the nozzle peripheral region. The damage is caused by the absorbing member making contact with the nozzle surface of the liquid ejecting head in order to absorb the liquid.

According to an aspect of the invention, there is provided a liquid ejecting apparatus which includes a liquid ejecting head which ejects a liquid from a plurality of nozzles disposed on a nozzle surface; an absorbing member which makes contact with the nozzle surface and can absorb a liquid which is adhered to the nozzle surface; and a pressing member which causes the ink absorbing member to contact the nozzle surface by pressing the absorbing member from a side which opposes a side which contacts the nozzle surface. In the liquid ejecting apparatus, a pressure applied to a nozzle peripheral region within the nozzle surface due to the absorbing member which is pressed by the pressing member making contact with the nozzle surface is smaller than a pressure applied to a region other than the nozzle peripheral region within the nozzle surface.

In this configuration, the absorbing member which is pressed by the pressing member makes contact with the nozzle surface. Accordingly, the pressure applied to the nozzle peripheral region is smaller than the pressure applied to the region other than the nozzle peripheral region. Therefore, when the absorbing member makes contact with the nozzle surface and absorbs the liquid, it is possible to effectively absorb the liquid which is adhered to the nozzle surface while suppressing the damage sustained by the nozzle peripheral region.

In addition, in the liquid ejecting apparatus described above, it is preferable that a compression ratio of a portion of the absorbing member which is pressed by the nozzle peripheral region be smaller than a compression ratio of a portion of the absorbing member which is pressed by a region other than the nozzle peripheral region.

In this configuration, the compression ratio of the portion of the absorbing member which is pressed by the nozzle peripheral region is smaller than the compression ratio of the portion of the absorbing member which is pressed by the region other than the nozzle peripheral region. Accordingly, the pressure is appropriately adjusted according to a difference in the region of the absorbing member which presses the nozzle surface. Accordingly, it is possible to effectively remove the liquid which is adhered to the nozzle surface using absorption while suppressing the damage to the nozzle peripheral region when the absorbing member makes contact therewith.

In addition, in the liquid ejecting apparatus described above, it is preferable that the region other than the nozzle peripheral region be a protruding surface which protrudes further than the nozzle peripheral region and that an entirety of a last contacted region in the direction in which the absorbing member wipes the nozzle surface be the protruding surface. In addition, it is preferable that a pressure applied to the last contacted region be set to be greater than a pressure applied to the nozzle peripheral region when the absorbing member makes contact with both the nozzle peripheral region and the protruding region, and to be smaller than a pressure applied to the protruding surface.

In this configuration, the absorbing member makes contact with both the protruding surface and the nozzle peripheral region, and absorbs the liquid which is adhered to the nozzle surface in the order of the wiping direction. Furthermore, the entirety of the last contacted region in the direction in which the absorbing member wipes the nozzle surface is the protruding surface. In the wiping process, in which the absorbing member makes contact with both the protruding surface and the nozzle peripheral region, a comparatively great pressure of a portion of the absorbing member which contacts the protruding surface is reduced when the absorbing member makes contact with the protruding surface of the last contacted region. Therefore, a force which absorbs the liquid (a suction force) is generated in the absorbing member. For example, after wiping liquid from the protruding surface, when an unabsorbed liquid is present, it is possible to cause the absorbing member to absorb at least a portion of the unabsorbed liquid at the end of the wiping. In addition, for example, when the liquid absorption amount of the absorbing member, which absorbs the liquid in the order of the wiping direction, is comparatively great, it is possible to avoid a portion of the liquid from being pushed out from the absorbing member at the last contacted region.

In the liquid ejecting apparatus described above, it is preferable that the region other than the nozzle peripheral region be a protruding surface which protrudes more than the nozzle peripheral region, and that the protruding surface be less liquid repellant than the nozzle peripheral region.

In this configuration, the liquid on the protruding surface is likely to spread wetly. Therefore, the absorbing member easily absorbs the liquid on the protruding surface. For example, when a configuration is adopted in which the liquid repellence is great and the liquid does not spread wetly, the liquid is more likely to collect near to the boundary between the nozzle peripheral region and the protruding surface. Therefore, the liquid absorption performance is reduced at a portion corresponding to nearby the boundary of the absorbing member which absorbs comparatively more of the liquid at a portion near the boundary. However, the liquid spreads wetly on the protruding surface which has a comparatively low liquid repellence. Therefore, the absorbing member can efficiently absorb the liquid on the protruding surface.

Furthermore, in the liquid ejecting apparatus described above, it is preferable that a stationary plate be provided on a surface which includes the nozzles of the liquid ejecting head, and that the stationary plate be provided with an opening, which exposes the nozzle peripheral region, in a portion which corresponds to the nozzle peripheral region.

In this configuration, the pressure applied to an opening portion of the stationary plate by the pressing of the pressing member is smaller than the pressure applied to a portion other than the opening of the stationary plate. In a comparatively simple configuration such as this, in which the stationary plate is simply provided on the liquid ejecting head, it is possible to apply different pressures to the nozzle peripheral region and the region other than the nozzle peripheral region.

In the liquid ejecting apparatus described above, it is preferable that the pressing member include a concave portion in a portion which corresponds to the nozzle peripheral region, and include a convex portion in a portion which corresponds to a region other than the nozzle peripheral region.

In this configuration, in a comparatively simple configuration, in which a concave portion and a convex portion are provided in the pressing member, it is possible to apply different pressures to the nozzle peripheral region and the region other than the nozzle peripheral region by using the absorbing member which is pressed by the pressing member.

BRIEF DESCRIPTION OF THE DRAWINGS

The invention will be described with reference to the accompanying drawings, wherein like numbers reference like elements.

DESCRIPTION OF EXEMPLARY EMBODIMENTS

Description will be given below of an ink jet printer which is an example of the liquid ejecting apparatus with reference to FIGS. 1 to 8.

Figure 1:
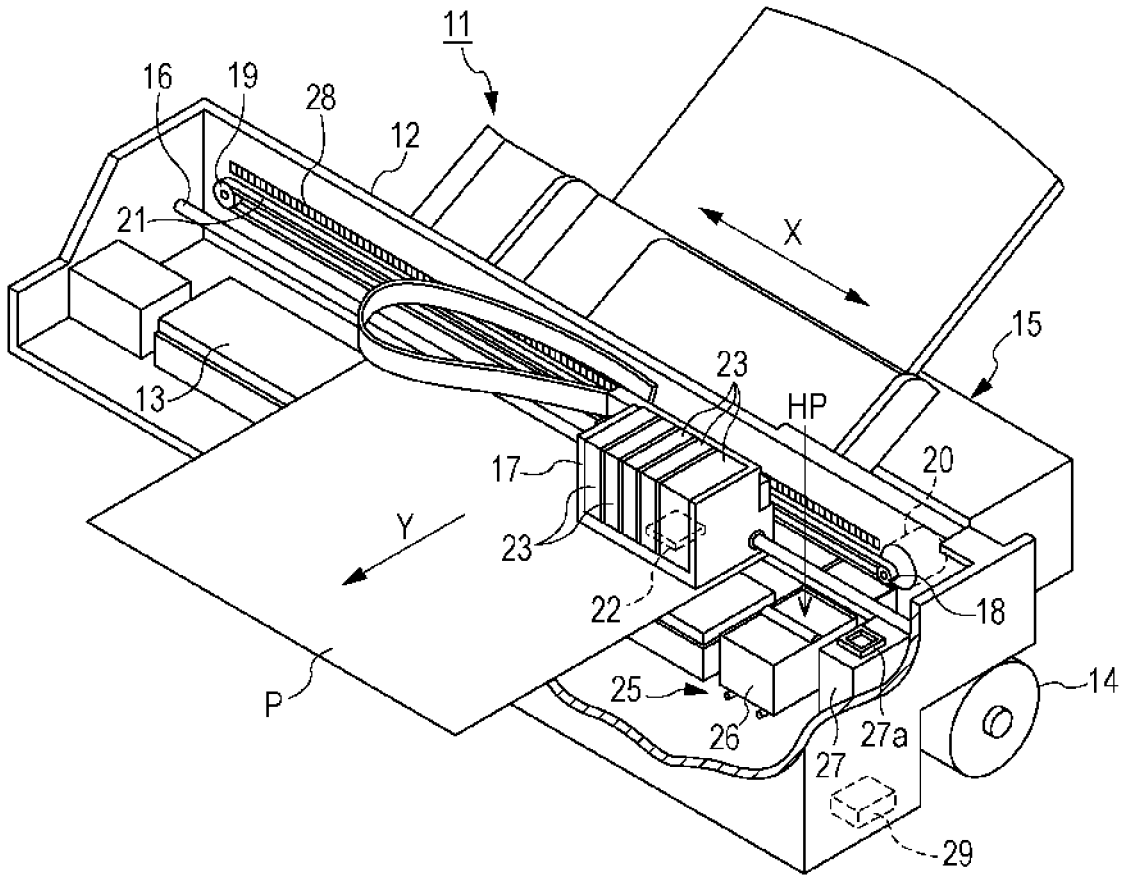
FIG. 1 is a perspective view showing a printer in an embodiment.

As shown in FIG. 1, in a printer 11, there is a support member 13 of a substantially rectangular plate shape in a frame 12 of a substantially rectangular box shape with an opening in the upper side thereof. The support member 13 is disposed on the lower portion of the inside of the frame 12 in a state in which the support member 13 extends in the main scanning direction X (the left-right direction in FIG. 1). A recording medium P is transported in a sub-scanning direction Y (a transport direction) which intersects a main scanning direction X on the support member 13 by a feed roller and transport roller pair (neither of which are shown) which are driven by the power of a transport motor 14 which is provided on the lower portion of a rear side of the frame 12. In addition, a carriage 17 is supported by a guide shaft 16, which is provided across the upper portion of the support member 13, in a state of being reciprocally movable in the main scanning direction.

A drive pulley 18 and a driven pulley 19 are supported at the positions near both end portions of the guide shaft 16 in the frame 12 in a freely rotatable state. The output shaft of a carriage motor 20, which serves as the drive source when causing the carriage 17 to move reciprocally, is connected to the drive pulley 18. In addition, an endless timing belt 21 is mounted between the pair of pulleys 18 and 19, in a state in which a portion of the timing belt 21 is connected to the carriage 17. Therefore, the carriage 17 is reciprocally movable in the main scanning direction X along the guide shaft 16 due to the forward and backward rotation of the timing belt 21 through the power of the carriage motor 20.

A liquid ejecting head 22 is provided on the lower portion of the carriage 17. Meanwhile, a plurality of (in the embodiment, five) ink cartridges 23 which store an ink (a liquid) to be supplied to a liquid ejecting head 22 are installed in an attachable and detachable manner to the upper side of the carriage 17. Furthermore, the ink droplets are ejected from the liquid ejecting head 22 onto the recording medium P, which is fed on the support member 13, thereby printing an image or the like onto the recording medium P. Furthermore, the recording medium P, which serves as the target of printing of the printer 11 in the embodiment, may be for example, paper, a fabric, film or the like. For example, the printer 11 is also capable of printing onto towels, clothing (shirts and the like) and the like.

Inks of different colors are accommodated in each of a plurality of the ink cartridges 23. As an example, inks of each of the colors of cyan (C), magenta (M), yellow (Y), black (K) and white (W) are accommodated in each of the ink cartridges 23. Color printing and the like onto the recording medium P is performed by ejecting the inks, which are supplied from each of the ink cartridges 23, from the liquid ejecting head 22. As an example, when the recording medium P is a deep color, after performing a white print (substrate printing), color printing is performed thereon. Furthermore, the mounting system of the ink cartridges 23 is not limited to a so-called on-carriage type in which the ink cartridges 23 are mounted into the carriage 17, and may be a so-called off-carriage type in which the ink cartridges 23 are mounted into a cartridge holder of the printer main body side in an attachable and detachable manner.

In addition, as shown in FIG. 1, within the frame 12, a maintenance apparatus 25 for performing maintenance of the liquid ejecting head 22 is provided on the lower side of the home position HP at which the carriage 17 waits when not printing. The maintenance apparatus 25 includes a wiping apparatus 26 which wipes the liquid ejecting head 22, a capping apparatus 27 which includes a cap 27*a* which caps the liquid ejecting head 22, and a suction pump (not shown) which is driven when ink with an increased viscosity or the like is evacuated by suction from the nozzles of the liquid ejecting head 22 by sucking the inside of the cap 27*a*. When the liquid ejecting head 22 performs flushing in which ink droplets are discharged in order to perform nozzle cleaning with no relation to printing, the cap 27*a* is used as the discharge destination of the ink droplets.

As shown in FIG. 1, in the frame 12, a linear encoder 28, which outputs a number of pulses which is proportional to the movement amount of the carriage 17, is provided in a position of the rear side of the carriage 17 so as to extend along the guide shaft 16. In addition, the printer 11 is provided with a controller 29 which manages the printing control and the maintenance control. The controller 29 performs drive control of the carriage motor 20 on the basis of the output pulse of the linear encoder 28, and performs positional control and speed control of the carriage 17. In addition, the controller 29 performs drive control of the transport motor 14 in order to feed and transport the recording medium P. Furthermore, when the controller 29 determines that the maintenance execution conditions have been met, the controller 29 causes the carriage 17 to move to a predetermined position of the home position HP side and subsequently causes at least one of the wiping apparatus 26 and the capping apparatus 27 to be driven in order to perform the necessary maintenance of wiping and cleaning.

Figure 2:
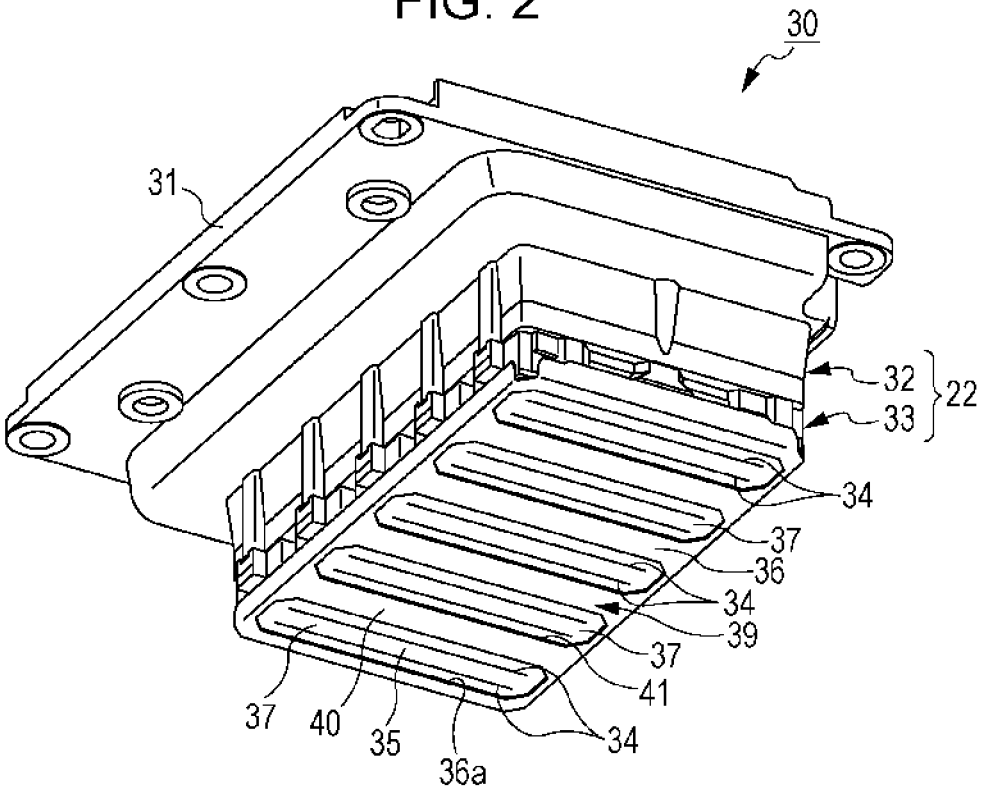
FIG. 2 is a perspective view showing a liquid ejecting head.

The head unit 30 shown in FIG. 2 is attached to the lower surface portion of the carriage 17. In addition, the head unit 30 includes a bracket portion 31 for attaching the head unit 30 to the carriage 17, and a liquid ejecting head 22 of a rectangular prism shape which extends downward from the bracket portion 31. The liquid ejecting head 22 includes a flow path forming portion 32 of a rectangular prism shape which protrudes downward from the bracket portion 31, and a head main body 33 of a rectangular plate shape which is fixed to the lower side of the flow path forming portion 32. A plurality (10 rows, for example) of nozzle rows 34 is formed on the lower surface of the head main body 33 in FIG. 2. In addition, a head cover 36, which is an example of the stationary plate which includes a plurality of (five, for example) openings 36*a* (through holes), is attached to the lower side of the head main body 33 in a state of covering a portion of the nozzle forming surface 35 (the lower surface in the example) on which each of nozzles 38 (refer to FIG. 3) which configure the nozzle rows 34 are formed. A predetermined number of rows (2 rows, for example) of the plurality of nozzle rows 34 is exposed by each of the openings 36*a*. In the example, the region which is exposed by the opening 36*a* of the nozzle forming surface 35 is a nozzle peripheral region 37.

Figure 3:
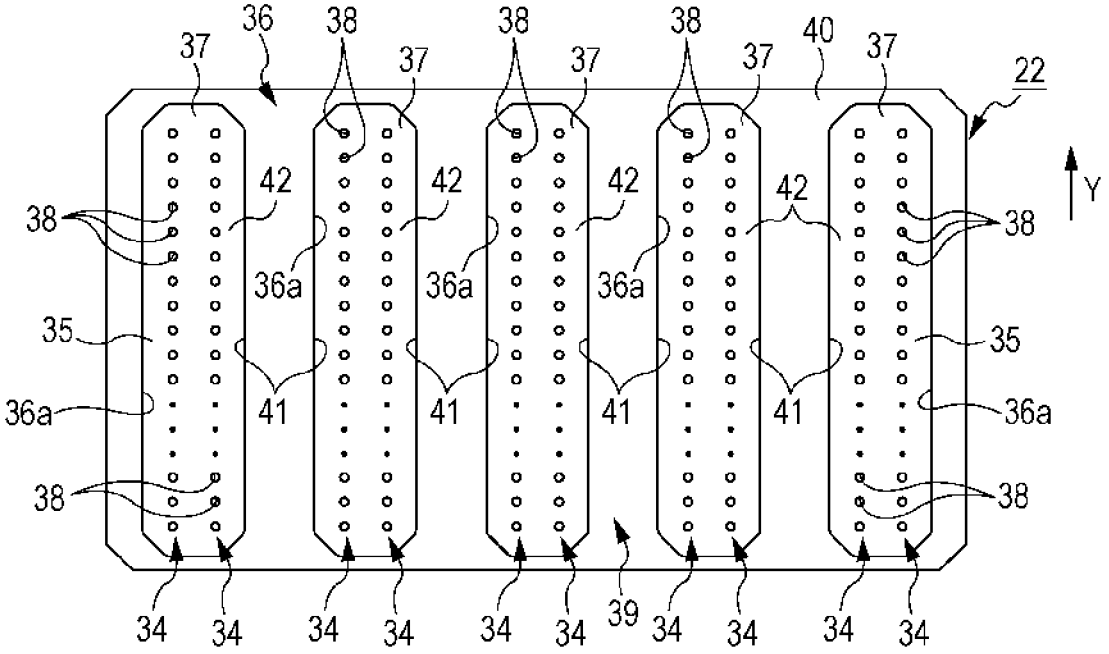
FIG. 3 is a schematic bottom view showing the liquid ejecting head.
Figure 4:
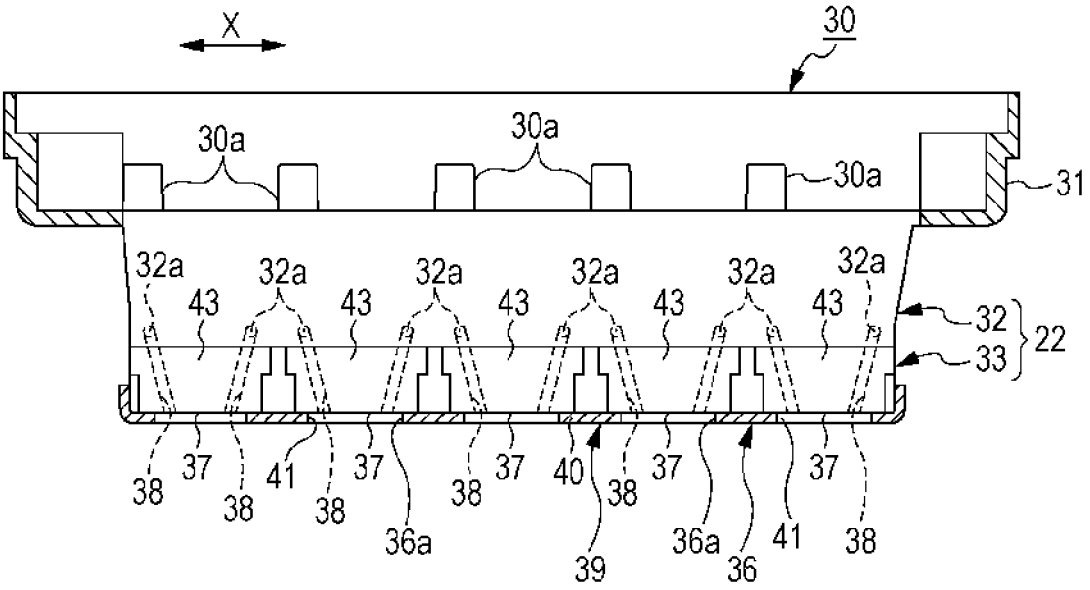
FIG. 4 is a schematic cross-sectional view showing the liquid ejecting head.

The head cover 36 shown in FIGS. 3 and 4 is fixed to the liquid ejecting head 22 by a fixing structure such as a lock in a state of covering a portion other than the nozzle peripheral region 37 which is exposed by the openings 36*a* within the nozzle forming surface 35. The entire bottom surface of the liquid ejecting head 22 shown in FIG. 3 is a nozzle surface 39, which is the wiping target of the wiping apparatus 26. The nozzle surface 39 includes the nozzle peripheral region 37 (that is, the region within the opening 36*a*), and a protruding surface 40 which is the region other than the nozzle peripheral region 37 and protrudes further than the nozzle peripheral region 37 by an amount which is equivalent to the thickness of the head cover 36. There is a level difference 41 between the nozzle peripheral region 37 and the protruding surface 40. In addition, the nozzle surface 39 is an uneven surface with a concave portion at the portion of the nozzle peripheral region 37 and a convex portion at the portion of the protruding surface 40. Furthermore, the head cover 36 is made of metal (for example, stainless steel) for example.

As shown in FIG. 3, the nozzle row 34 is formed from a multitude of (for example, 180 or 360) the nozzles 38 which are disposed along the sub-scanning direction Y at a fixed pitch. Each of the nozzle rows 34 ejects one color of ink which corresponds to the ink color of the respective ink cartridge 23. Naturally, the nozzle rows 34 may eject a color other than the 4 colors of CMYK and while (W), and they may eject, for example, light magenta, light cyan, light yellow, grey, orange, or the like. In addition, the number of colors of the liquid ejecting head 22 may be 4 color CMYK, 3 color CMY, 1 color black, or the like. Furthermore, an unused nozzle row which does not eject ink may also be present within the plurality of nozzle rows 34.

In addition, the nozzle forming surface 35 shown in FIG. 3 is subjected to liquid repellant processing (ink repellant processing) which repels the ink, and a liquid repellant film 42 (an ink repellant film) is formed on the surface thereof. The ink used in the embodiment is an example of the pigment ink. In the pigment ink, a multitude of pigment particles are dispersed within the liquid which is used as the dispersion medium. Pigments which may be adopted include an organic pigment with an average particle diameter of 100 nm as a cyan, a magenta, or a yellow pigment, a carbon black (an inorganic pigment) with an average particle diameter of 120 nm as a black pigment, and a titanium oxide (an inorganic pigment) with an average particle diameter of 320 nm as a white pigment. The ink of the example is an aqueous ink where a multitude of pigment particles are dispersed in water, which is the dispersion medium. Therefore, in the example, the liquid repellant film 42 is a water repellant film with a function of repelling aqueous ink. The liquid repellant film 42 is gradually abraded by the repeated wiping of the nozzle forming surface 35, and when the liquid repellant film 42 is abraded by a fixed amount or more, the liquid repellence thereof is reduced. Furthermore, the liquid repellant film 42 may be a liquid repellant coating film, and may also be a liquid repellant monomolecular film. The film thickness and the liquid repellant processing method may be selected arbitrarily.

In this reduced liquid repellence state, the wetting angle (contact angle) of the liquid such as the ink mist in relation to the nozzle peripheral region 37 is reduced. Therefore, a plurality of specks of ink mist which are adhered to the nozzle peripheral region 37 spread wetly, and are likely to grow to form one comparatively wide ink droplet (adhered ink). As a result, there is a concern that this type of adhered ink will be present in the periphery of the nozzles 38, or will block a portion of the openings of the nozzles 38. Furthermore, there is a concern that the adhered ink will flow into the nozzles 38. When ink droplets are ejected from the nozzles 38 in this state, the ejected ink droplets make contact with the adhered ink, which causes the ink droplets to fly astray. Such flying astray of the ink droplets causes the landing position (that is, the printed dot formation position) of the ink droplets onto the recording medium P to shift from the position which they are assumed to land at, which brings about a reduction in the printed image quality. For these reasons, it is necessary to suppress the abrasion of the liquid repellant film 42 caused by wiping as much as possible.

Meanwhile, the head cover 36 is manufactured by machining a metal plate into a predetermined shape, and the surface thereof is not subjected to liquid repellant processing. Therefore, the protruding surface 40 has less liquid repellence than the nozzle peripheral region 37. In other words, the wetting angle of the ink in relation to the protruding surface 40 is smaller than the wetting angle of the ink in relation to the nozzle peripheral region 37.

As shown in FIG. 4, the liquid ejecting head 22 includes a plurality of (for example, 5 in the embodiment) recording heads 43 (unit heads) which are arranged in rows in the main scanning direction X at a fixed pitch. The rim portion of the nozzle forming surface 35, which is the lower surface of the recording heads 43, is covered by the head cover 36, and the nozzle peripheral region 37 which includes 2 rows of the nozzles 38 is exposed from the opening 36*a* which is perforated in the head cover 36. Each of the nozzles 38 communicates with each ink flow path 32*a* which passes through the flow path forming portion 32. Furthermore, the ink flow paths 32*a* communicate with a plurality of supply tube portions 30*a* which protrude upward from the upper surface of the flow path forming portion 32 via the flow paths (not shown). Each of the supply tube portions 30*a* communicates with the supply port of each of the ink cartridges 23, which are mounted into the cartridge holder (not shown) on the carriage 17, via a flow path (not shown). Accordingly, the ink of each color is supplied to the corresponding nozzle 38 of the corresponding recording head 43 through each of the supply tube portions 30*a* and the ink flow paths 32*a* from each of the ink cartridges 23 (refer to FIG. 1). Furthermore, in the case of an off-carriage type, each of the supply tube portions 30*a* is connected to the supply port of each of the ink cartridges which are mounted into the cartridge holder of the printer main body side (none of which are shown) through a tube. In addition, the liquid ejecting head 22 may also be configured from 1 head which includes 3 or more nozzle rows.

As shown in FIGS. 3 and 4, as described above, the nozzle surface 39 of the liquid ejecting head 22 includes the protruding surface 40 which is formed from a peripheral portion of the openings 36*a* in the lower surface of the head cover 36, and a nozzle peripheral region 37 which is concave and is exposed at the portions of the openings 36*a*. Furthermore, in FIG. 4, in order to clarify the uneven shape of the nozzle surface 39, the thickness of the head cover 36 is depicted thicker than in reality in an exaggerated manner.

Figure 5:
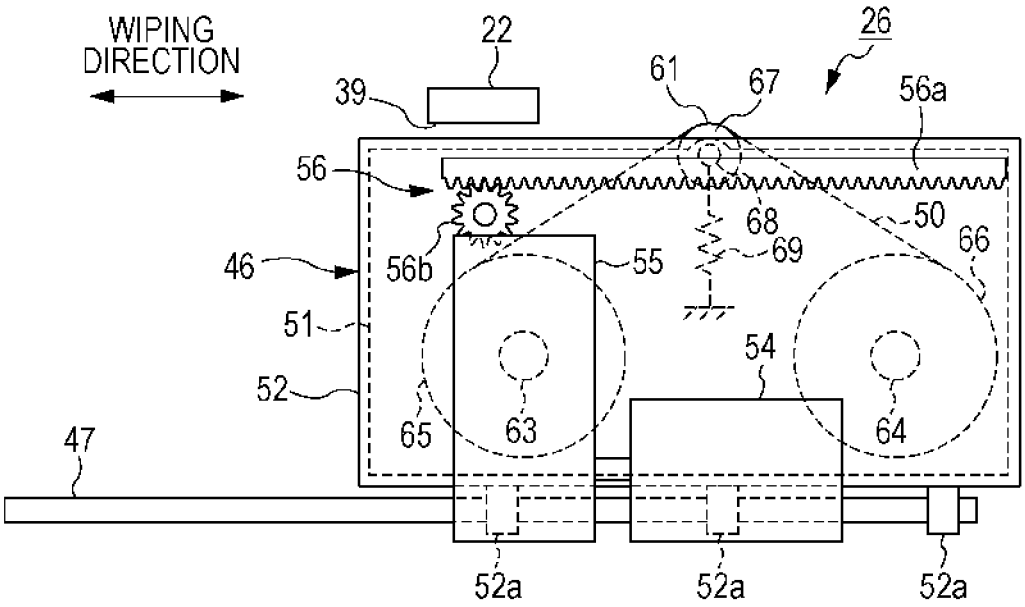
FIG. 5 is a schematic side view showing a wiping apparatus.

Next, description will be given of the wiping apparatus 26 using FIG. 5. As shown in FIG. 5, the wiping apparatus 26 includes a wiper unit 46 which is reciprocally movable in the wiping direction, and a rail portion 47 which movably guides the wiper unit 46 in the wiping direction. The wiper unit 46 includes a wiper cassette 51 with a belt-shaped fabric sheet 50 installed therein, and a wiper holder 52 into which the wiper cassette 51 is mounted in a freely attachable and detachable manner. The fabric sheet 50 is an example of the absorbing member which abuts the nozzle surface 39 and absorbs the ink. The wiper holder 52 is guided along the rail portion 47 via a guide portion 52*a*, which is fixed to the lower portion of the wiper holder 52, and is reciprocally movable in the wiping direction (the sub-scanning direction Y). The printer main body side (for example, the frame 12) is provided with an electric motor 54 which serves as the power source, and a power transmission mechanism 55 which transmits the power of the electric motor 54.

As shown in FIG. 5, a rack and pinion mechanism 56 is provided on the side portion of the wiper holder 52. The rack and pinion mechanism 56 includes a rack gear portion 56*a*, the longitudinal direction of which is fixed in an orientation which matches the wiping direction, on the side surface of the wiper holder 52, and a pinion gear portion 56*b* which meshes with the rack gear portion 56*a* and is rotated by the power which is transmitted via the power transmission mechanism 55. When the electric motor 54 performs forward rotational driving, the pinion gear portion 56*b* rotates forward and, together with the rack gear portion 56*a*, the wiper holder 52 moves out from the withdrawn position shown in FIG. 5 to the upstream side in the transport direction Y (leftward in FIG. 5). The electric motor 54 stops after the moving out, and next performs backward rotational driving. In this case, the pinion gear portion 56*b* which meshes with the rack gear portion 56*a* rotates backward, and the wiper holder 52 returns to the withdrawn position shown in FIG. 5 by moving back to the downstream side in the transport direction Y (rightward in FIG. 5).

As shown in FIG. 5, the wiper unit 46 includes a semi-cylindrical fabric wiper 61 which protrudes upward from the upper surface portion of the wiper cassette 51. Furthermore, the wiper unit 46 moves in the wiping direction from the withdrawn position shown in FIG. 5 along the rail portion 47. Therefore, the wiping of the fabric wiper 61 is performed in relation to the nozzle surface 39 of the liquid ejecting head 22.

As shown in FIG. 5, a feed shaft 63 and a winding shaft 64 are axially supported within the wiper cassette 51 in a state of being distanced from one another by a predetermined distance in the wiping direction. A feed roll 65, around which the unused fabric sheet 50 is wound, is mounted on the feed shaft 63. In addition, a wound roll 66, around which the used fabric sheet 50 is wound, is mounted on the winding shaft 64. The fabric sheet 50 which is mounted between both the rolls 65 and 66 is wound around the outer peripheral surface of a pressing roller 67, which is an example of the pressing member which partially protrudes upward from an opening 51*a* (refer to FIG. 6) of the central portion of the upper surface of the wiper cassette 51, from above, and forms a semi-cylindrical fabric wiper 61 with the portion which is wound around the pressing roller 67. A supporting shaft 68 which supports the pressing roller 67 is biased upward by the spring 69, and the fabric wiper 61 is in a state of being biased upward. According to each of the portions 63 to 69, the wiper unit 46 includes a function of applying a bias to the fabric wiper 61 toward the side at which the fabric wiper 61 abuts the nozzle surface 39, and a sheet exchanging function of exchanging a portion of the fabric sheet 50 which is wound around the pressing roller 67 from a used portion to an unused portion.

Here, in a state in which the wiper unit 46 shown in FIG. 5 is in a moving-out complete position, for example, according to a clutch mechanism (not shown) within the power transmission mechanism 55, the transmission of power to the pinion gear portion 56*b* is blocked, and the feed shaft 63 and the winding shaft 64 are connected to the power transmission mechanism 55 such that power transmission can occur therebetween. In this state, according to the power which is transmitted from the electric motor 54 via the power transmission mechanism 55, the feed shaft 63 and the winding shaft 64 rotate, the unused fabric sheet 50 is fed out from the feed roll 65, and the used fabric sheet 50 is wound onto the wound roll 66. During this time, the carriage 17 withdraws from the wiping position. Furthermore, after the wiping operation is completed to this point, the electric motor 54 performs backward rotation driving and the wiper unit 46 moves back and returns to the withdrawn position shown in FIG. 5. Furthermore, the clutch mechanism may also be a mechanism which can release the meshing of the pinion gear portion 56*b* with the rack gear portion 56*a* and switch to a state in which power can be transmitted to the winding shaft 64. Other well-known clutch mechanisms may also be adopted.

Figure 6:
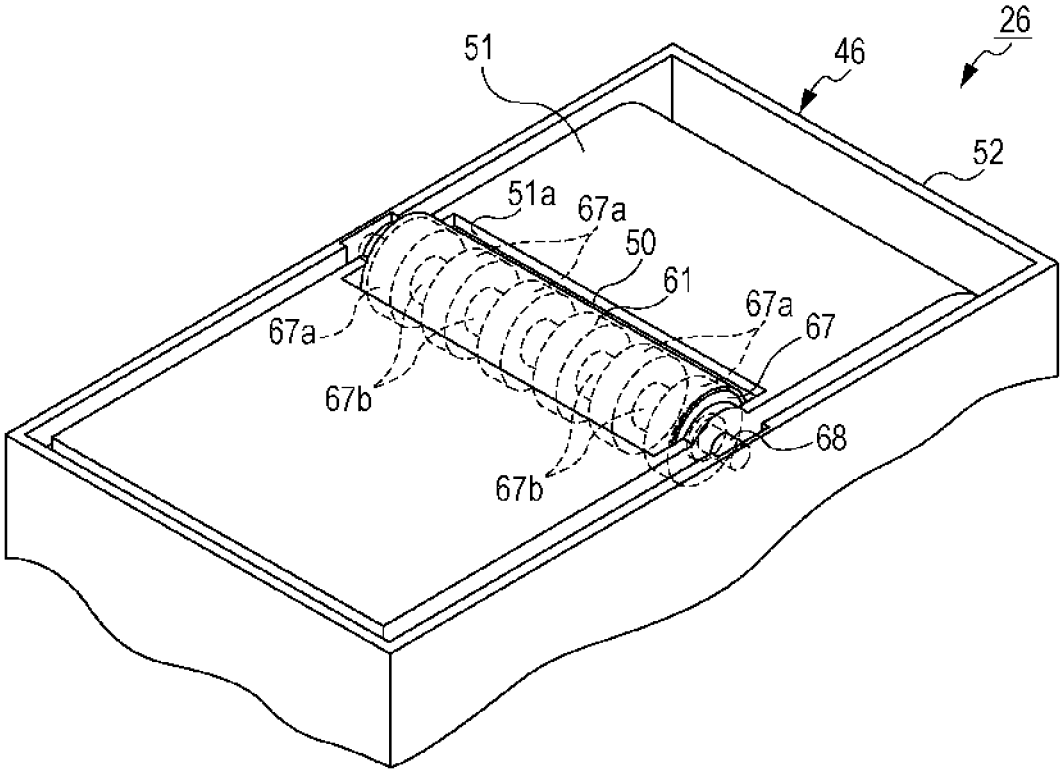
FIG. 6 is a partial perspective view showing the wiping apparatus.

The length of the semi-cylindrical fabric wiper 61 shown in FIG. 6 in the axial direction is slightly longer than the length (the width) of the nozzle surface 39 of the liquid ejecting head 22 side in the main scanning direction X. Therefore, it is possible for the fabric wiper 61 to wipe the entirety of the nozzle surface 39. The pressing roller 67 is configured by one roller which is slightly longer than the length (the width) of the nozzle surface 39 in the main scanning direction X.

As shown in FIG. 6, the pressing roller 67 includes a function of pressing the fabric sheet 50 from a side opposite to the side at which the pressing roller 67 contacts the nozzle surface 39, and causing the fabric sheet 50 to contact the nozzle surface 39. The single pressing roller 67 is a graded roller in which a cylindrical large diameter portion 67*a*, which is a convex portion, and a cylindrical small diameter portion 67*b*, which is a concave portion, are alternately lined up in the axial direction. In the pressing roller 67, a portion which corresponds to the protruding surface 40 of the head cover 36 is the large diameter portion 67*a*, and a portion which corresponds to the nozzle peripheral region 37 is the small diameter portion 67*b*.

Specifically, a plurality of (six, in the example) the large diameter portions 67*a* are arranged in the axial direction with an interval therebetween of the thickness of the openings 36*a* (refer to FIGS. 2 and 3) of the liquid ejecting head 22 side in relation to the supporting shaft 68. In this configuration, the portion of the fabric sheet 50 which is wound around the large diameter portion 67*a* can be pushed against the protruding surface 40 within the nozzle surface 39 with a relatively great pressure. Furthermore, the portion of the fabric sheet 50 which corresponds to the small diameter portion 67*b* can be pushed against the nozzle peripheral region 37, which is concave and positioned on the nozzle surface 39, with a relatively small pressure so as to suppress the abrasion thereof.

Accordingly, when the electric motor 54 shown in FIG. 5 performs forward rotational driving, the wiper unit 46 moves out from the withdrawn position of the same drawing along the wiping direction. In this moving out process (the wiping process), the portion of the fabric wiper 61 which corresponds to the large diameter portion 67*a* of the pressing roller 67 abuts the protruding surface 40 with a great pressure due to the pressing force from the large diameter portion 67*a* while moving. At this time, since the portion of the fabric wiper 61 which corresponds to the small diameter portion 67*b* of the pressing roller 67 is not pressed by the pressing roller 67, the portion moves while abutting the nozzle peripheral region 37 with a smaller pressure than the pressure applied to the protruding surface 40. Furthermore, after the wiping operation by the fabric wiper 61 is completed, for example, the liquid ejecting head 22 withdraws from the wiping position, and subsequently, the wiper unit 46 moves back to the withdrawn position due to the backward rotation driving of the electric motor 54.

Figure 7A:
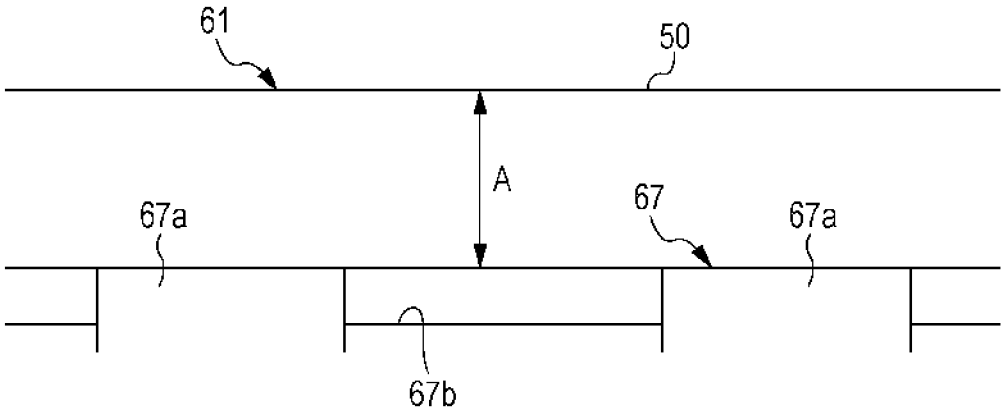
FIG. 7A is a schematic front view showing a non-pressed state of a fabric sheet.

In addition, an example of the belt-shaped fabric sheet 50 which configures the fabric wiper 61 shown in FIG. 7A is a nonwoven fabric. In the example, synthetic fiber is used for the material of the fabric sheet 50, and cupra is used as an example thereof. Naturally, in addition to synthetic fibers such as polyester, rayon, acrylic, acetate, nylon and polyurethane, it is also possible to use natural fibers such as wool, cotton and hemp. In addition, the fabric sheet 50 may also be a woven fabric instead of a nonwoven fabric.

Figure 7B:
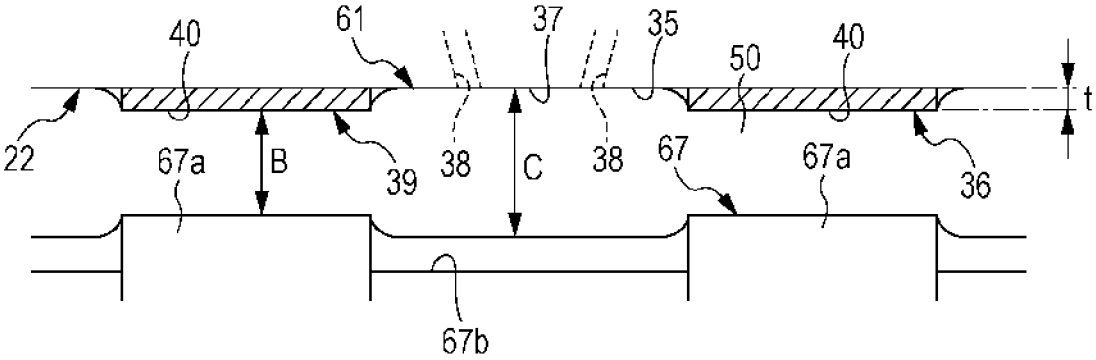
FIG. 7B is a schematic front cross-sectional view showing the non-pressed state of the fabric sheet.

As shown in FIG. 7A, the thickness of the fabric sheet 50 in a non-pressed state(when not wiping), in which the fabric sheet 50 is not being pressed by the nozzle surface 39, is set to A. As shown in FIG. 7B, the thickness of a portion of the fabric sheet 50 which corresponds to the protruding surface 40 when the fabric wiper 61 is not being pressed by the nozzle surface 39 is set to B, and the thickness of a portion which corresponds to the nozzle peripheral region 37 is set to C. At this time, the magnitude relationship of each of the thicknesses of the fabric sheet 50 is A>C>B. Furthermore, the plate thickness t of the head cover 36 is, for example, a value within a range of 0.08 mm to 0.15 mm.

In the embodiment, each of the thicknesses A to C is a value within the following range, for example. The thickness A of the fabric sheet 50 in a non-pressed state is a value within the range of 0.3 mm to 0.5 mm. In addition, the thickness B of a portion of the fabric sheet 50 which is pressed by the protruding surface 40 is a value within the range of 0.2 mm to 0.3 mm, for example, and the thickness C of a portion of the fabric sheet 50 which is pressed by the nozzle peripheral region 37 is a value within the range of 0.3 mm to 0.45 mm (however, B<C), for example. For example, when the fabric sheet 50, which is formed from a nonwoven fabric made of cubra where thickness A=4.0 mm, is used, when the plate thickness of the head cover 36 is set to 0.1 mm, for example, it is preferable that the thickness B be a value within the range of 0.25 mm to 0.3 mm, for example, and that the thickness C be a value within the range of 0.32 mm to 0.37 mm, for example.

Accordingly, during the wiping of the fabric wiper 61, the compression ratio K of the fabric sheet 50 is as follows. The compression ratio Kb of a portion which presses the protruding surface 40 of the fabric wiper 61 is represented by Kb=(A−B)/A×100(%), and the compression ratio Kc of a portion which presses the nozzle peripheral region 37 is represented by Kc=(A−C)/A×100(%). From the relationship A>C>B, it can be understood that the compression ratios are Kb>Kc. In other words, the compression ratio Kc of the portion of the fabric sheet 50 which presses the nozzle peripheral region 37 is smaller than the compression ratio Kb of the portion of the fabric sheet 50 which presses the protruding surface 40. The greater the compression ratio K is, the greater the pressure (the wiping pressure), which is applied to the nozzle surface 39 by the fabric sheet 50, becomes. Therefore, the pressure, which is applied to the nozzle peripheral region 37 by the portion of the fabric wiper 61 which corresponds to the nozzle peripheral region 37, is smaller than the pressure which is applied to the protruding surface 40 by the portion of the fabric wiper 61 which corresponds to the protruding surface 40. For example, when A=4.0 mm, B=0.25 mm and C=0.35 mm, each of the compression ratios Kb and Kc respectively become Kb=38 (%), and Kc=13(%). It is preferable that the compression ratio Kb be a value in the range of 30% to 50%, for example, and that the compression ratio Kc be a value in the range of 10% to 20%, for example.

In addition, since the compression ratio K and density are in a predetermined relationship, from the relationships of the compression ratios Kb and Kc described above, the density of the portion of the fabric sheet 50 which presses the nozzle peripheral region 37 is smaller than the density of the portion of the fabric sheet 50 which presses the protruding surface 40. This density relationship means that the porosity of the portion of the fabric sheet 50 which presses the nozzle peripheral region 37 is greater than the porosity of the portion of the fabric sheet 50 which presses the protruding surface 40.

Figure 8A:
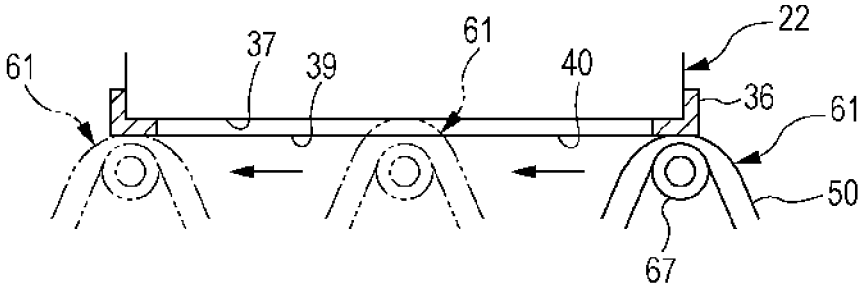
FIG. 8A is a schematic side view illustrating a wiping operation.
Figure 8B:
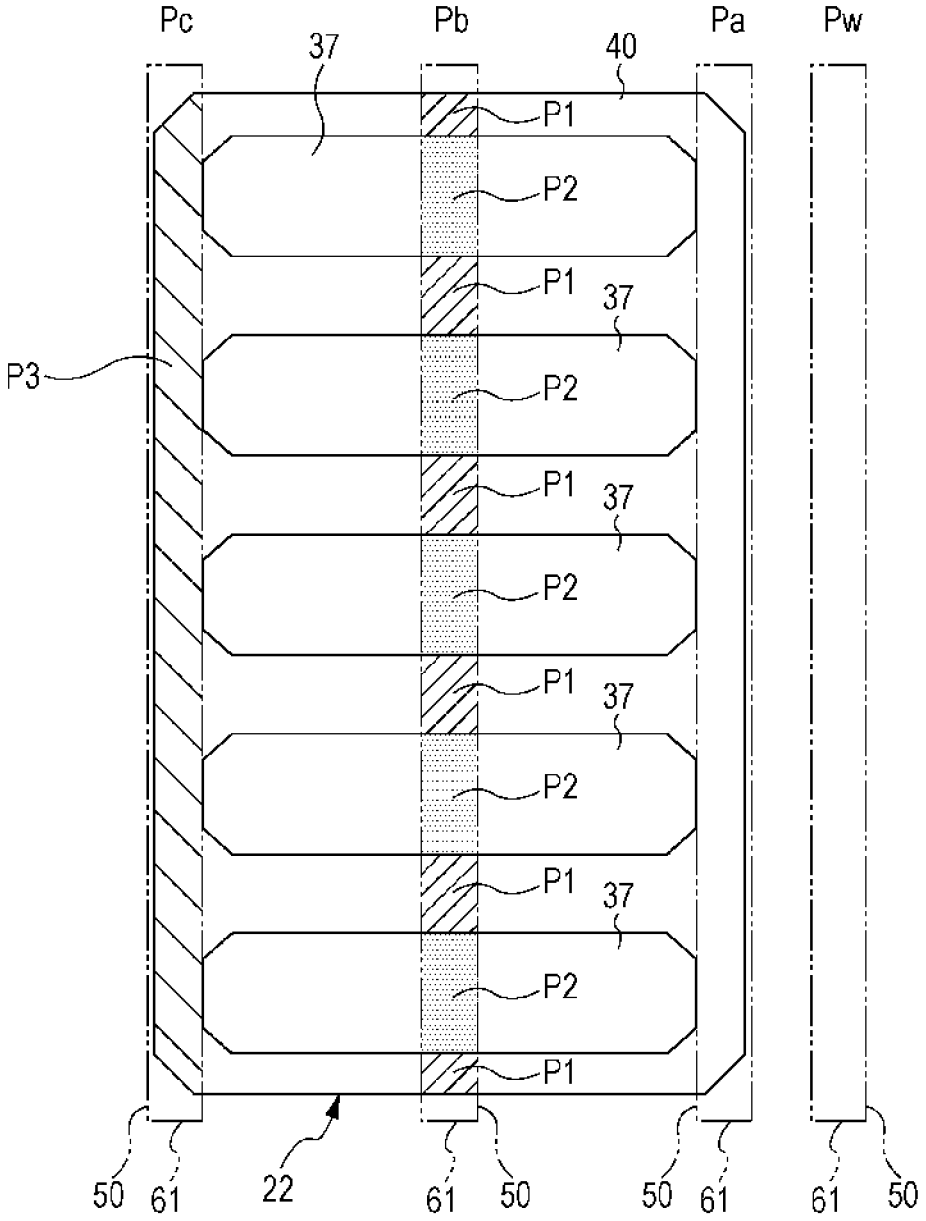
FIG. 8B is a schematic bottom view showing a pressure which is applied to the nozzle surface by the fabric sheet in the wiping process.

As shown in FIG. 8A, in the process in which the fabric wiper 61 moves in the direction of the arrow in the same drawing and wipes the nozzle surface 39, as shown in FIG. 8B, the pressure (the wiping pressure) at which the fabric wiper 61 contacts the nozzle surface 39 is different according to the part of the fabric sheet 50 contacting the nozzle surface 39 being different at each grade. As shown in FIG. 8B, description will be given, with reference to the same drawing, of the pressure of the fabric wiper 61 in relation to the nozzle surface 39 at each stage of a process in which the fabric wiper 61 moves leftward in the same drawing from the waiting position P, which is positioned on the right side of the liquid ejecting head 22 in the same drawing, and performs a wiping operation.

First, at the position Pa shown in FIG. 8B, where the fabric wiper 61 first contacts the nozzle surface 39, the entire region of the nozzle surface 39 which the fabric wiper 61 contacts is the protruding surface 40. At this time, the fabric wiper 61 contacts the nozzle surface 39 (that is, the protruding surface 40) with a pressure Po. Next, when the fabric wiper 61 passes the region at which the fabric wiper 61 first contacts the nozzle surface 39, as shown in the position Pb in FIG. 8B, the fabric wiper 61 moves to a region at which the fabric wiper 61 contacts both the nozzle peripheral region 37 and the protruding surface 40. As shown in the example of the position Pb in FIG. 8B, the fabric wiper 61 contacts the protruding surface 40 with the pressure P1, and the nozzle peripheral region 37 with the pressure P2. At this time, the pressure P2 of the portion of the fabric wiper 61 which presses the nozzle peripheral region 37 is smaller than the pressure P1 of the portion of the fabric wiper 61 which presses the protruding surface 40 (P2<P1).

Furthermore, after the wiping of this range is completed, at the position Pc shown in FIG. 8B, where the fabric wiper 61 last contacts the nozzle surface 39, the entire region of the nozzle surface 39 which the fabric wiper 61 contacts is again the protruding surface 40. At this time, the fabric wiper 61 contacts the protruding surface 40 with a pressure P3 (=Po). However, the pressure P3 changes according to the change in the contact area between the fabric wiper 61 and the protruding surface 40. Here, in the wiping process, the load of the pressing roller 67 is received by the nozzle surface 39. At the position Pb, while a portion of the load of the pressing roller 67 is dispersed to the nozzle peripheral region 37, the load is mainly received by the protruding surface 40, and at the position Pc, the load of the pressing roller 67 is received by the protruding surface 40. The area of the portion which receives the pressure P1 on the protruding surface 40 is sufficiently smaller than the area of the portion which receives pressure P3 on the protruding surface 40. Accordingly, the pressures P1 to P3 are in a P1>P3>P2 relationship.

Next, description will be given of the effects of the printer 11 which includes the wiping apparatus 26 with reference to FIGS. 7, 8 and the like.

In the printer 11 of a serial type, the printing to the recording medium P progresses by alternately repeating a printing operation, in which the recording medium P is subjected to 1 scan worth of recording by ejecting ink droplets from the nozzles 38 of the liquid ejecting head 22 while the carriage 17 moves in the main scanning direction X, and a transport operation in which the recording medium P is transported to the next printing position. During the printing, the wiper unit 46 of the wiping apparatus 26 waits at the withdrawn position shown in FIG. 5.

For example, in a predetermined period during the printing, the controller 29 determines whether or not it is necessary to perform wiping, and when wiping is determined to be necessary, the controller 29 drive controls the carriage motor 20, causing the carriage 17 to move in the wiping direction. When the carriage 17 is determined to have reached the wiping position and stopped on the basis of the discrete value of a counter (not shown) which counts the output pulse of the linear encoder 28, the controller 29 causes the electric motor 54 to perform forward rotational driving. Therefore, the wiper unit 46 is guided from the withdrawn position to the rail portion 47 and moves out in the wiping direction.

Before the wiping, the nozzle surface 39 is in a state in which an ink mist or the like which occurs during the printing is adhered thereto. Furthermore, as shown in FIG. 8A, the fabric wiper 61 wipes the nozzle surface 39 due to the wiper unit 46 moving out. At this time, the portion of the fabric sheet 50 which is pressed by the large diameter portion 67*a* of the pressing roller 67 is pushed against the protruding surface 40 with a relatively great pressure. Therefore, the adhered ink on the protruding surface 40 is absorbed by the fabric wiper 61 and is wiped off in a substantially reliable manner.

At this time, the portion of the pressing roller 67 which corresponds to the openings 36*a* is the small diameter portion 67*b*, and the portion of the fabric sheet 50 which corresponds to the nozzle peripheral region 37 is not pressed by the pressing roller 67, thereby avoiding being pushed into the openings 36*a* with a strong pressing force. As a result, the portion of the fabric wiper 61 which corresponds to the openings 36*a* contacts the nozzle peripheral region 37 with a smaller pressure than the pressure (the wiping pressure) at which the portion which corresponds to the protruding surface 40 makes contact therewith. At this time, the compression ratio Kc of the portion of the fabric sheet 50 which presses the nozzle peripheral region 37 is smaller than the compression ratio Kb of the portion of the fabric sheet 50 which presses the protruding surface 40. Furthermore, the fabric wiper 61 moves in the wiping direction in a state of contacting with the pressures P1 and P2 of the position Pb shown in FIG. 8B. Therefore, the adhered ink on the nozzle surface 39 is wiped off while being absorbed by the fabric sheet 50.

Since there are particles of pigment in the ink which the fabric wiper 61 absorbs, during the wiping, when the fabric sheet 50 moves in a state of abutting the nozzle peripheral region 37 with a strong pressure, the nozzle peripheral region 37 is subjected to damage by the abrasive effect of the pigment particles. When wiping which subjects the nozzle peripheral region 37 to damage is repeatedly performed and the liquid repellence thereof is reduced, this causes the ink droplets to fly astray, and there is a concern that this will bring about a reduction in the printed image quality.

However, in the embodiment, the fabric wiper 61 wipes the nozzle peripheral region 37 with a smaller pressure than the pressure applied to the protruding surface 40. Therefore, even if the wiping is performed repeatedly, the liquid repellence of the nozzle peripheral region 37 is not easily reduced. As a result, the ink droplets do not easily fly astray, and it is possible to print at high printed image quality over a comparatively long period.

In addition, as shown by the position Pb in FIG. 8B, at a region at which the fabric wiper 61 makes contact with both the nozzle peripheral region 37 and the protruding surface 40, the fabric wiper 61 moves in the wiping direction in a state of contacting the protruding surface 40 with the pressure P1, and the nozzle peripheral region 37 with the pressure P2, which is smaller than the pressure P1. Furthermore, after the wiping of this region is completed, at the position Pc shown in FIG. 8B, where the fabric wiper 61 last contacts the nozzle surface 39, the entire region of the nozzle surface 39 which the fabric wiper 61 contacts is the protruding surface 40, and the pressure of the fabric wiper 61 changes from the pressure P1 which the fabric wiper 61 presses the protruding surface 40 with until this point to the smaller pressure P3. As a result, a suction force, which absorbs the ink at the last region in the wiping direction, acts on the fabric wiper 61. Therefore, it is possible to cause at least a portion of the unabsorbed ink to be absorbed by the fabric sheet 50 at the last stage of the wiping by wiping the ink from the protruding surface 40. In addition, for example, it is possible to avoid the seeping out of the ink from the fabric sheet 50 which may occur due to an increase in the pressure at which the fabric wiper 61 contacts the protruding surface 40 at the last stage of the wiping.

In addition, since the liquid repellence in relation to the ink of the protruding surface 40 is low in comparison with that of the nozzle peripheral region 37, the adhered ink on the protruding surface 40 spreads wetly comparatively easily. Therefore, the ink on the protruding surface 40 is effectively absorbed using a wide area of the fabric wiper 61. When the liquid repellence of the protruding surface 40 is high, the ink which moves from the nozzle peripheral region 37 along the level difference 41 (the inner wall surface of the opening 36*a*) to the protruding surface 40 side gathers near the level difference 41 without spreading wetly. Since the ink is absorbed intensively at a local area of the fabric wiper 61 which corresponds to the level difference 41, the ink absorbing performance of the portion of the local area decreases. In this case, post-wiping remaining ink is likely to be present near the level difference 41. However, in the embodiment, the ink on the protruding surface 40, which has a low liquid repellence, spreads wetly more easily than on the nozzle peripheral region 37, and the wetly spread ink can be absorbed over a wide range by the fabric wiper 61. As a result, post-wiping remaining ink is unlikely to be present near the level difference 41 on the nozzle surface 39.

According to the embodiments described above, it is possible to obtain the following effects.

(1) According to the fabric sheet 50 which is pressed by the pressing roller 67, the pressure applied to the nozzle peripheral region 37 within the nozzle surface 39 is set to be smaller than the pressure applied to the protruding surface 40, which is a region other than the nozzle peripheral region 37 within the nozzle surface 39. Therefore, during the wiping by the wiping apparatus 26, it is possible to effectively remove the ink which is adhered to the protruding surface 40 using absorption while suppressing the damage sustained by the nozzle peripheral region 37. As a result, the abrasion speed of the liquid repellant film 42 can be reduced. Accordingly, occurrence of the ink droplets flying astray, caused by a reduction in the liquid repellence of the nozzle peripheral region 37, can be suppressed, and it is possible to print onto the recording medium P at high printed image quality over a long period.

(2) The compression ratio Kc of the portion of the fabric sheet 50 which contacts the nozzle peripheral region 37 during the wiping is set to be smaller than the compression ratio Kb of the portion of the fabric sheet 50 which contacts the protruding surface 40 ($Kc<Kb$). Accordingly, the pressures, which are applied to each region according to a difference in the regions of the nozzle surface 39 side which the fabric sheet 50 contacts, are appropriately adjusted such that the pressure applied to the nozzle peripheral region 37 is smaller than the pressure applied to the protruding surface 40. For example, a method, in which a special fabric sheet is used in which the density (the porosity) of the fabric is made to differ for each region in advance according to the differences in the regions of the nozzle surface 39 side which the fabric sheet contacts, can be considered in order to perform the pressure adjustment described above. However, it is not necessary to use such a special fabric sheet.

(3) The pressure P3, which is applied to the protruding surface 40 which the fabric sheet 50 contacts last in the wiping direction in relation to the nozzle surface 39, is set to be greater than the pressure P2 applied to the nozzle peripheral region 37, and is set to be smaller than the pressure P1 applied to the protruding surface 40 in the wiping process, in which the fabric sheet 50 makes contact with both the nozzle peripheral region 37 and the protruding surface 40, which is performed in the previous stage. Therefore, when the pressure P1, which is applied to the protruding surface 40 by the fabric sheet 50 in the wiping process described above, last weakens to the pressure P3, the compressed state of the fabric sheet 50 is released slightly. Therefore, a suction force is generated in the fabric sheet 50. Accordingly, for example, after wiping an ink from the protruding surface 40, when an unabsorbed ink is present, it is possible to cause the fabric sheet 50 to absorb at least a portion of the unabsorbed ink at the end of the wiping. In addition, for example, when the ink absorption amount of the fabric sheet 50, which absorbs the ink in the order of the wiping direction, is comparatively great, it is possible to avoid a portion of the ink from being pushed out from the fabric sheet 50 at the last contacted region.

(4) Since the liquid repellence of the protruding surface 40 is lower than that of the nozzle peripheral region 37, the ink which travels from the nozzle peripheral region 37 to the level difference 41 spreads wetly on the protruding surface 40. Therefore, the ink on the protruding surface 40 can be efficiently absorbed using a wide area of the fabric wiper 61.

(5) The openings 36*a* which expose the nozzle peripheral region 37 are formed on the head cover 36, which is attached to the nozzle forming surface 35 of the liquid ejecting head 22, at a portion which corresponds to the nozzle peripheral region 37. Accordingly, using a comparatively simple configuration in which the openings 36*a* are provided in the head cover 36, it is possible to appropriately adjust the compression ratios of the portion of the fabric sheet 50 which corresponds to the nozzle peripheral region 37 and the portion which corresponds to the protruding surface 40. Therefore it is possible to differ the respective pressures applied to the nozzle peripheral region 37 and the protruding surface 40 by the fabric sheet 50.

(6) The pressing roller 67 includes a concave portion formed from the small diameter portion 67*b* which is formed in a portion which corresponds to the nozzle peripheral region 37, and a convex portion formed from the large diameter portion 67*a* which is formed in a portion which corresponds to the protruding surface 40. Using a comparatively simple configuration in which the pressing roller 67 is a graded roller, it is possible to apply different pressures to the nozzle peripheral region 37 and the protruding surface 40.

The embodiments are not limited to those described above, and may also be realized using the following modes.

Figure 9:
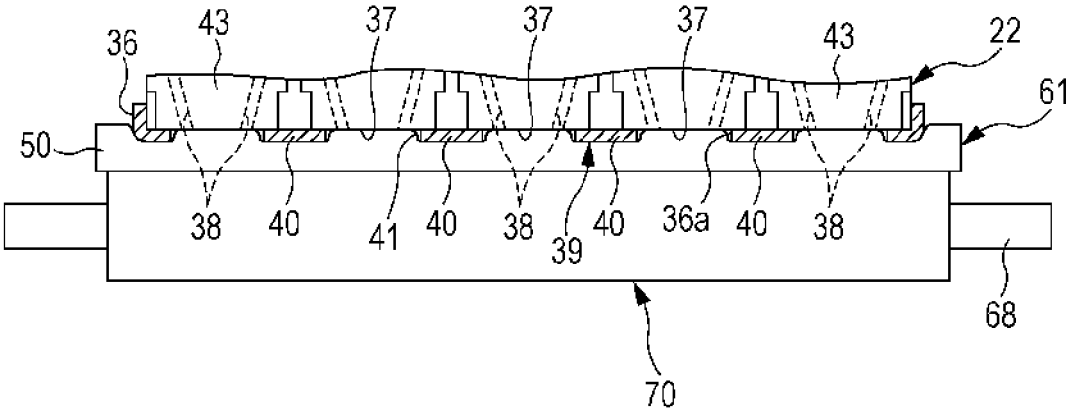
FIG. 9 is a schematic front cross-sectional view showing a portion of a wiping apparatus of a modification example.

The pressing roller is set to a graded roller, however, a pressing roller 70 formed from a cylindrical roller with no level difference, as shown in FIG. 9, may also be employed. Even in this configuration, as shown in FIG. 9, the head cover 36 which is provided on the liquid ejecting head 22 side has the openings 36*a* in a portion which corresponds to the nozzle peripheral region 37. Therefore, the compression ratio Kc of the portion of the fabric sheet 50, which is compressed during the wiping, which corresponds to the nozzle peripheral region 37 is smaller than the compression ratio Kb of the portion of the fabric sheet 50 which corresponds to the protruding surface 40. Therefore, the pressure, which is applied to the nozzle peripheral region 37 by the fabric sheet 50 during the wiping, is smaller than the pressure which is applied to the protruding surface 40.

The load of the pressing roller 67 in the wiping process may also be changed such that the relationship between each of the pressures P1 to P3 in the process in which the fabric wiper 61 moves in the arrow direction of FIG. 8A and wipes the nozzle surface 39 becomes P1>P3>P2. For example, it is possible to reduce the load of the pressing roller 67 at the last contacted position Pc shown in FIG. 8B, and to increase the ink-absorbing suction force of the fabric wiper 61 at the last region in the wiping direction. In addition, the ink can be more reliably recovered from the protruding surface 40 by slowing down the movement speed of the fabric wiper 61 to a slower speed than the movement speed until this point, by temporarily stopping the movement, or the like.

Figure 10:
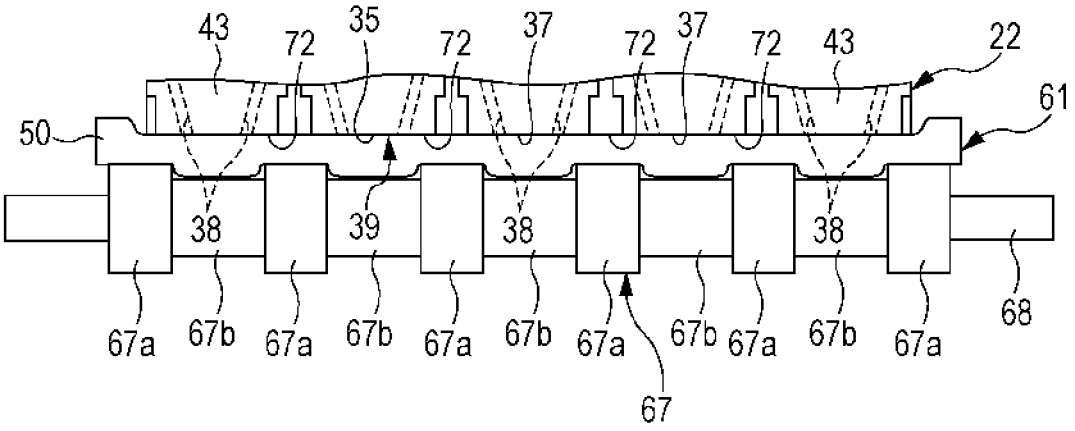
FIG. 10 is a schematic front cross-sectional view showing a portion of a wiping apparatus of a different modification example from that of FIG. 9.

As shown in FIG. 10, the head cover 36 may be omitted. That is, the nozzle surface 39 of the liquid ejecting head 22 may also be a flat surface with no level difference between the nozzle peripheral region 37 and a peripheral region 72 surrounding the nozzle peripheral region 37. Even in this configuration, if a graded roller is adopted as the pressing roller 67 shown in FIG. 10, in which the portion which corresponds to the nozzle peripheral region 37 is the small diameter portion 67*b* and the portion which corresponds to the peripheral region 72 is the large diameter portion 67*a*, it is possible to wipe the nozzle peripheral region 37 with a smaller pressure than the pressure applied to the peripheral region 72 during the wiping. Accordingly, it is possible to effectively remove the ink which is adhered to the nozzle surface 39 using absorption while suppressing the damage to the nozzle peripheral region 37. Furthermore, the nozzle surface without grading is not limited to being configured by the nozzle forming surface 35 itself, and may also be formed by attaching a head cover, in which nozzle holes that can communicate with the nozzles 38 are formed, to the nozzle forming surface 35 of the liquid ejecting head 22.

Figure 11:
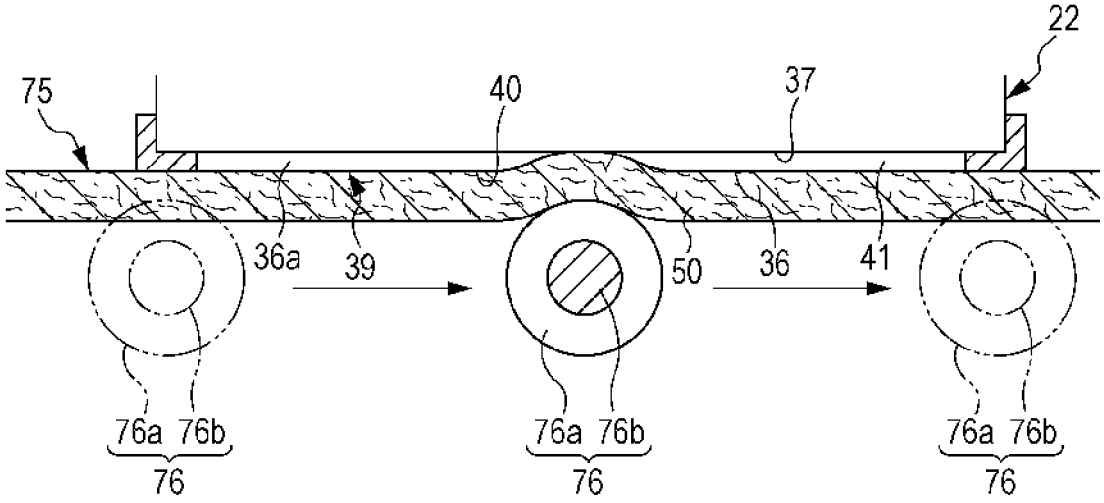
FIG. 11 is a schematic side cross-sectional view showing a portion of a wiping apparatus of a different modification example from that of FIG. 10.

The fabric wiper may also adopt a configuration in which the fabric sheet absorbs the ink by causing the pressing roller to move. The pressing roller is pushed against the fabric sheet, which is maintained on the lower side of the nozzle surface in a state of being horizontal with the nozzle surface, from the opposite side from the nozzle surface side. For example, as shown in FIG. 11, a fabric wiper 75 includes the fabric sheet 50 which is maintained in a state of being horizontal with the nozzle surface 39 in a state of contacting or being slightly distanced from the nozzle surface 39 at a position opposing the nozzle surface 39, and a pressing roller 76 which is an example of the pressing member which is movable in the wiping direction (the arrow direction in the drawing) in a state of being pushed against the surface of the opposite side of the fabric sheet 50 from the nozzle surface 39 side. A supporting shaft (not shown) which rotatably supports the pressing roller 76 is supported via a spring (not shown) on a slider (not shown) which is movable in a direction parallel with the wiping direction, and is biased to the nozzle surface 39 side. The fabric wiper 75 includes a mechanism which maintains the biggest possible region of the fabric sheet 50 which can abut the entirety of the nozzle surface 39 at once in an orientation parallel to the nozzle surface 39, a mechanism which raises and lowers the maintaining mechanism such that it is possible to approach and distance the maintaining mechanism in relation to the nozzle surface 39, and a mechanism which can feed out and wind up the fabric sheet 50 in order to change a portion of the fabric sheet 50 maintained in the maintaining mechanism from a used portion to an unused portion. In addition, the pressing roller 76 is configured by the same graded roller as shown in FIG. 6, and includes a large diameter portion 76*a* (a convex portion) which is formed in a portion which corresponds to the protruding surface 40, and a small diameter portion 76*b* (a concave portion) which is formed in a portion which corresponds to the nozzle peripheral region 37.

Instead of one roller (the graded roller), the pressing roller may also adopt a configuration in which a plurality of rollers of a width which corresponds to the protruding surface 40 are disposed along the axial direction of the pressing roller on the supporting shaft or the rotating shaft thereof at an interval corresponding to the width of the nozzle peripheral region 37. Even in this configuration, the pressure at which the fabric sheet 50 contacts the nozzle peripheral region 37 can be made smaller than the pressure at which the fabric sheet 50 contacts the protruding surface 40. Therefore, it is possible to effectively wipe the nozzle surface while suppressing the damage to the nozzle peripheral region 37.

The pressures which the fabric sheet 50 applies to the nozzle peripheral region 37 and to the region other than the nozzle peripheral region 37 may also be differed. The difference is achieved using a fabric sheet in which the density of the portion of the fabric sheet 50 which corresponds to the nozzle peripheral region 37 is set lower in advance than the density of the portion which corresponds to the region other than the nozzle peripheral region 37. For example, the fabric sheet 50 is used in which, in the width direction (the direction intersecting the nozzle row) of the fabric sheet 50, a portion which corresponds to the nozzle peripheral region 37 is a low-density fiber portion, and a portion which corresponds to the region other than the nozzle peripheral region 37 is a high-density fiber portion. In this case, even if the fabric sheet 50 is pressed with a uniform load in the width direction thereof using a pressing member such as a cylindrical pressing roller, the pressure, which is applied to the nozzle peripheral region 37 by the fabric sheet 50, can be set to be smaller than the pressure which is applied to the region other than the nozzle peripheral region 37.

The pressing member may also be a non-rotatable pressing member which includes a pressing surface that corresponds to the nozzle surface.

The pressing members such as the pressing rollers 67, 70 and 76 may also be omitted. Simply by causing the fabric sheet to abut the nozzle surface 39 in a tensile state, as long as the head cover 36 has the openings 36*a* in a portion which corresponds to the nozzle peripheral region 37, the pressure with which the fabric sheet 50 contacts the nozzle peripheral region 37 can be set to be smaller than the pressure with which the fabric sheet 50 contacts the protruding surface 40. In addition, the ink may also be removed by absorption by using the capillary force which occurs when the fabric sheet is caused to contact the ink which is adhered to the nozzle surface 39, without causing the fabric sheet to contact the nozzle surface 39.

In the embodiments described above, the nozzle surface 39 is wiped during the moving out of the fabric wiper. However, a configuration may also be adopted in which the nozzle surface 39 is wiped during the moving back, or during both the moving out and the moving back. In addition, the wiping direction of the fabric wiper may also be set equally to the main scanning direction X.

For example, the opening of the head cover may also be configured as a single opening which exposes all of the nozzle rows. In addition, the openings of the head cover may also be formed for each of the nozzle rows.

A configuration may also be adopted in which, by fixing the wiper unit to the printer main body and due to the carriage passing through the wiping position, the nozzle surface of the carriage is caused to slide against the wiper portion which is waiting in the wiping position.

The absorbing member may be a fabric. The fabric refers to a fabric in which a multitude of fibers are processed into a wide plate shape, and may also be a woven textile, a knitted textile, lace, felt, a nonwoven textile or the like. Furthermore, as long as the absorbing member has liquid absorbency, something other than a fabric may also be employed. For example, the absorbing member may also be a porous material made of a resin which has absorbency such as sponge.

The liquid ejecting apparatus is not limited to a serial printer, and may also be a line printer or a page printer.

The recording medium is not limited to paper, fabric, film or the like and may also be a metal sheet, a ceramic sheet, or the like. In addition, the recording medium is not limited to a flat shape and may also be three-dimensional.

The liquid ejecting apparatus is not limited to the printer 11 which ejects ink, and may also be a liquid ejecting apparatus which ejects or discharges a liquid other than ink. Furthermore, the state of the liquid discharged as minute droplets from the liquid ejecting apparatus includes liquids of a droplet shape, a tear shape and liquid which forms a line shaped tail. In addition, the liquid referred to herein may be a material which can be ejected from a liquid ejecting apparatus. For example, the liquid may be a material which is in a liquid phase state, and includes liquid bodies of high or low viscosity, and fluid bodies such as sol, gel water, other inorganic solvents, organic solvents, solutions, liquid resin, and liquid metal (molten metal). In addition, the liquid not only includes liquids as a state of a material, but also includes solutions, disperses and mixtures in which particles of functional material formed from solids such as pigments and metal particulate are dissolved, dispersed or mixed into a solvent. Representative examples of the liquid include the ink of the embodiment described above or a liquid crystal. Here, the term "ink" includes general aqueous inks and solvent inks, in addition to various liquid compositions such as jell ink and hot melt ink. A specific example of the liquid ejecting apparatus is a liquid ejecting apparatus which ejects a liquid which contains a material such as an electron material or a color material in the form of a dispersion or a solution. The electron material may be used in the manufacture and the like of liquid crystal displays, EL (electroluminescence) displays, surface emission displays and color filters. In addition, the liquid ejecting apparatus may also be a liquid ejecting apparatus which ejects biological organic matter used in the manufacture of bio-chips, a liquid ejecting apparatus which is used as a precision pipette to eject a liquid to be a sample, a textile printing apparatus, a micro dispenser or the like. Furthermore, the liquid ejecting apparatus may also be a liquid ejecting apparatus which ejects lubricant at pinpoint precision into precision machines such as clocks and cameras, or a liquid ejecting apparatus which ejects a transparent resin liquid such as ultraviolet curing resin onto a substrate in order to form minute semispherical lenses (optical lenses) used in optical communication elements and the like. In addition, the liquid ejecting apparatus may also be a liquid ejecting apparatus which ejects an acidic or alkaline etching liquid for etching a substrate or the like.

CROSS REFERENCES TO RELATED APPLICATIONS

The entire disclosure of Japanese Patent Application No. 2012-265015, filed Dec. 4, 2012 is expressly incorporated by reference herein.

What is claimed is:

1. A liquid ejecting apparatus, comprising:

a liquid ejecting head which ejects a liquid from a plurality of nozzles disposed on a nozzle surface;

an absorbing member which makes contact with the nozzle surface and absorbs a liquid which is adhered to the nozzle surface; and a pressing member which causes the absorbing member to contact the nozzle surface by pressing the absorbing member from a side which opposes a side which contacts the nozzle surface, wherein, when the absorbing member pressed by the pressing member is in contact with the nozzle surface, a pressure applied to a nozzle peripheral region is less than a pressure applied to a region other than the nozzle peripheral region within the nozzle surface, wherein the region other than the nozzle peripheral region is a protruding surface which protrudes further than the nozzle peripheral region and an entirety of a last contacted region in a wiping direction in which the absorbing member wipes the nozzle surface is the protruding surface, and wherein a pressure P3 applied to the last contacted region is set to be greater than a pressure P2 applied to the nozzle peripheral region when the absorbing member makes contact with both the nozzle peripheral region and the protruding region, and less than a pressure P1 applied to the protruding surface prior to being applied to the nozzle peripheral region such that P1>P3>P2.

2. The liquid ejecting apparatus according to claim 1, wherein a compression ratio of a first portion of the absorbing member which is pressed by the pressing member so as to contact the nozzle peripheral region is less than the compression ratio of a second portion of the absorbing member which is pressed by the pressing member so as to contact the region other than the nozzle peripheral region.

3. The liquid ejecting apparatus according to claim 1, wherein the protruding surface has a liquid repellency that is less than the liquid repellency of the nozzle peripheral region.

4. The liquid ejecting apparatus according to claim 1, wherein a stationary plate is provided on a surface which includes the nozzles of the liquid ejecting head, and the stationary plate is provided with an opening, which exposes the nozzle peripheral region, in a portion which corresponds to the nozzle peripheral region.

5. The liquid ejecting apparatus according to claim 1, wherein the pressing member includes a concave portion in a portion which corresponds to the nozzle peripheral region, and includes a convex portion in a portion which corresponds to a region other than the nozzle peripheral region.

6. A liquid ejecting apparatus, comprising:

a liquid ejecting head which ejects a liquid from a plurality of nozzles disposed on a nozzle surface;

an absorbing member which is configured to wipe the nozzle surface by moving in a wiping direction in contact with the nozzle surface; and a pressing member which causes the absorbing member to contact the nozzle surface by pressing the absorbing member from a side which opposes a side which contacts the nozzle surface, wherein, when a direction crossing the wiping direction is a crossing direction, the nozzle surface has a nozzle peripheral region including the plurality of nozzles and a surrounding region sandwiching the nozzle peripheral region in the wiping direction and the crossing direction, wherein the surrounding region is a protruding surface which protrudes further than the nozzle peripheral region, wherein, when the absorbing member pressed by the pressing member is in contact with the nozzle surface, a pressure applied to the nozzle peripheral region is less than a pressure applied to the surrounding region sandwiching the nozzle peripheral region in the crossing direction.

7. The liquid ejecting apparatus according to claim 6, wherein the protruding surface has a liquid repellency that is less than the liquid repellency of the nozzle peripheral region.

8. The liquid ejecting apparatus according to claim 6, wherein the liquid ejecting head includes a plate forming the protruding surface, and the plate is provided with an opening, which exposes the nozzle peripheral region, in a portion which corresponds to the nozzle peripheral region.

9. A liquid ejecting apparatus, comprising:

a liquid ejecting head which ejects a liquid from a plurality of nozzles disposed on a nozzle surface;

an absorbing member which is configured to wipe the nozzle surface by moving in a wiping direction in contact with the nozzle surface; and a pressing member which causes the absorbing member to contact the nozzle surface by pressing the absorbing member from a side which opposes a side which contacts the nozzle surface, wherein, when a direction crossing the wiping direction is a crossing direction, the nozzle surface has a nozzle peripheral region including the plurality of nozzles and a surrounding region sandwiching the nozzle peripheral region in the wiping direction and the crossing direction, wherein the pressing member includes a convex portion corresponds to the surrounding region, and includes a single concave portion corresponds to the nozzle peripheral region and is recessed from the convex portion, wherein, when the absorbing member pressed by the pressing member is in contact with the nozzle surface, a pressure applied to the nozzle peripheral region is less than a pressure applied to the surrounding region sandwiching the nozzle peripheral region in the crossing direction.

10. The liquid ejecting apparatus according to claim 9, wherein the surrounding region has a liquid repellency that is less than the liquid repellency of the nozzle peripheral region.

11. The liquid ejecting apparatus according to claim 9, wherein the surrounding region is a protruding surface which protrudes further than the nozzle peripheral region, wherein the liquid ejecting head includes a plate forming the protruding surface, and the plate is provided with an opening, which exposes the nozzle peripheral region, in a portion which corresponds to the nozzle peripheral region.

* * * * *